United States Patent [19]

Jamgotchian

[11] Patent Number: 4,609,238

[45] Date of Patent: Sep. 2, 1986

[54] MAGNETIC TERMINAL-PLATE CABLE END CONNECTION FOR BATTERY

[76] Inventor: George H. Jamgotchian, 2769 W. Mesa, Fresno, Calif. 93711

[21] Appl. No.: 698,542

[22] Filed: Feb. 5, 1985

[51] Int. Cl.[4] ..... H01R 11/30

[52] U.S. Cl. ..... 339/12 R; 339/224

[58] Field of Search ..... 339/12 R, 12 G, 12 L, 339/225, 224, 231, 263 B, 29 B

[56] References Cited

U.S. PATENT DOCUMENTS

| | | | |
|---|---|---|---|
| 1,507,936 | 9/1924 | Schmitt | 339/231 |
| 1,655,598 | 1/1928 | Diller | 339/224 |
| 2,234,982 | 3/1941 | Ross | 339/12 R |
| 2,489,475 | 11/1949 | Blind | 339/12 |
| 3,042,891 | 7/1962 | Navarro | 339/224 |
| 3,500,283 | 3/1970 | Bishop | 339/12 G |
| 3,750,083 | 7/1973 | Fayling | 339/12 R |
| 4,390,232 | 6/1983 | Jamgotchian | 339/12 R |

*Primary Examiner*—Gil Weidenfeld
*Assistant Examiner*—Thomas M. Kline
*Attorney, Agent, or Firm*—Harvey B. Jacobson

[57] ABSTRACT

A pair of generally parallel, electrically conductive and ferrous material plates are provided and permanent magnets structure is sandwiched between the plates. An elongated electrically conductive threaded fastener includes a portion thereof projecting outwardly from the side of one of the plates remote from the other plate and may be removably threadedly anchored within an endwise outwardly opening bore formed in a recessed battery post. An electrically conductive member is also provided to which one end of the battery cable may be electrically connected and the contact member includes at least generally one planar side. The contact member is positionable with the planar side thereof abutting, spanning and magnetically attracted to a pair of side marginal edges of the plates which are disposed in the same plane.

12 Claims, 6 Drawing Figures

MAGNETIC TERMINAL-PLATE CABLE END CONNECTION FOR BATTERY

BACKGROUND OF THE INVENTION

1. Field of the Invention

This invention relates to an adapter for attachment to an automotive or similar battery of the type including a flush or recessed battery post having an outwardly opening threaded bore formed therein. The adapter includes a outwardly projecting threaded shank portion for threaded anchoring in the aforementioned bore and a pair of parallel, electrically conductive and ferrous plates between which permanent magnet structure is sandwiched with at least one pair of marginal edges of the plates projecting outwardly from the magnet structure and disposed in the same plane. The adapter further includes a contact member having one planar side for abutting, spanning and magnetic securement to the aforementioned plate edges and the contact member includes structure whereby one end of a battery cable may be electrically connected thereto, the contact member also being constructed of electrically conductive ferrous material.

2. Description of Related Art

Various different forms of magnetic connectors for batteries and electrical contacts heretofore have been provided such as those disclosed in U.S. Pat. Nos. 3,750,083, 4,210,373 and 4,390,232. However, these previously known forms of connectors do not include the advantageous structural and operatonal features of the instant invention to be set forth hereinafter.

SUMMARY OF THE INVENTION

The instant invention utilizes an attachment equipped with an outwardly projecting threaded stud for threaded anchoring within a threaded outwardly opening bore formed in a battery post of the flush or recessed type and incorporates a pair of generally parallel, ferrous and electrically conductive plates between which a permanent magnetic is sandwiched with the plates including corresponding edge portions disposed in the same plane. In addition, the attachment includes a contact member having a planar side abutting, spanning the spacing between and magnetically attracted to the aforementioned plate edges. The contact member further includes structure whereby one end of the battery cable may be electrically connected thereto.

In many instances, it is desirable to quickly disconnect one or both of the cables from an automotive or marine battery. In addition, it is occasionally necessary to remove accumulated corrosion from between the surfaces establishing the electrical connection between a battery post and a battery cable.

However, conventional battery cable to battery connectors do not allow quick disconnect of a cable from a battery and do not lend themselves to ready removal of the aforementioned accumulated corrosion.

Further, different automotive battery installations require different positioning of the battery posts on batteries with the result that each size and capacity of an automotive battery may have to be constructed in two or three different configurations.

It is therefore an important object of this invention to provide a battery cable-to-battery post connection which will enable rapid and easy disconnect of a cable from a battery post and an easy reconnection of the battery cable to the battery post.

Another important object of this invention is to provide a battery cable-to-battery post connection which may be quickly cleaned of accumulated corrosion.

A third important object of this invention is to provide a battery cable-to-battery post connection constructed in a manner whereby a given size and capacity of battery may be used in many different automotive installations.

Another object of this invention is to provide a battery cable-to-battery post connector which will define handhold portions on a battery and relative to which associated battery cables are readily removably connected to thereby facilitate the manual removal of batteries from and the manual installation of batteries within various vehicles.

A final object of this invention to be specifically enumerated herein is to provide a battery cable-to-battery post connection which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
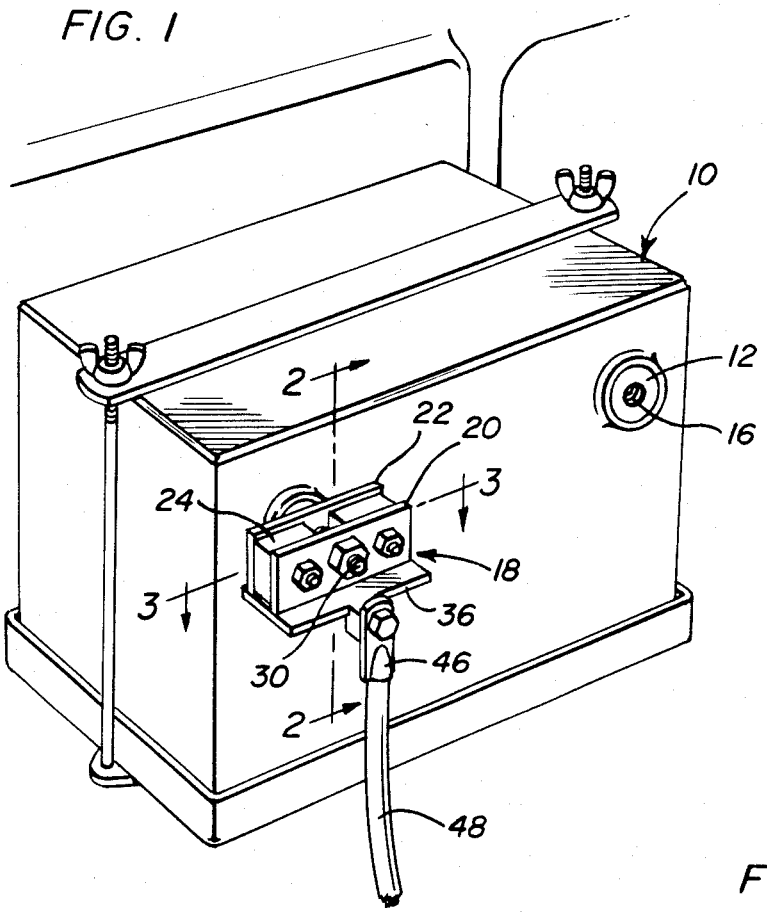
FIG. 1 is a perspective view of a conventional form of side terminal automotive battery with one terminal of which a first form of battery cable-to-battery terminal connector of the instant invention is operatively associated.

Referring now more specifically to the drawings, the numeral 10 generally designates a conventional form of automotive or similar battery equipped with flush or recessed side terminal posts 12 and 14 including outwardly opening threaded bores 16.

The magnetic terminal-to-cable end connector of the instant invention is referred to in general by the reference numeral 18 and includes a pair of ferrous and electrically conductive plates 20 and 22 of substantially rectangular configuration between which a pair of centrally apertured permanent magnets 24 are sandwiched. A pair of threaded shank-type fasteners 26 are secured through the plates 20 and 22 and the central apertures in the magnets 24 in order to define a unitary structure and the plates 20 and 22 each include a central opening 28 formed therethrough. Further, the magnets 24 are spaced apart and the spacing between the magnets 24 is registered with the openings 28 to define a passage extending through the plates 20 and 22 between the magnets 24. An elongated threaded stud 30 extends through the passage and a pair of threaded nuts 32 and 34 are threaded on the opposite ends of the stud 30 to further clamp the magnets 24 between the plates 20 and 22. The end of the stud 30 upon which the nut 34 is threaded projects endwise outwardly of the latter and is threadedly engaged in the bore 16 of the terminal 14.

By constructing the plates of substantially rectangular configuration and of substantially the same size, the plates 20 and 22 includes four pairs of corresponding edge portions disposed in corresponding planes. Further, the two pairs of corresponding longitudinal edges of the plates 20 and 22 are spaced outwardly of the corresponding sides of the magnets 24.

The connector 18 additionally includes a contact member 36 including a planar face 38 which is of a length substantially equal to the length of the plates 20 and 22, but which is of a width slightly greater than the spacing between the remote sides of the plates 20 and 22. One longitudinal marginal portion of the contact member 36 includes an outstanding lug 40 which projects outwardly of one side face of the contact member 36 and the lug 40 includes a threaded bore formed therethrough. A headed bolt or other similar fastener 44 is used to electrically connect the apertured end member 46 on one end of a battery cable 48 to the lug 40. Inasmuch as the contact member is constructed of ferrous and electrically conductive material and the fastener 44 is constructed of electrically conductive material, the cable 48 is electrically connected to the contact member 36. Further, the nut 34 serves as a spacer, whereby the plate 22 is maintained spaced from the terminal 14.

Figure 2:
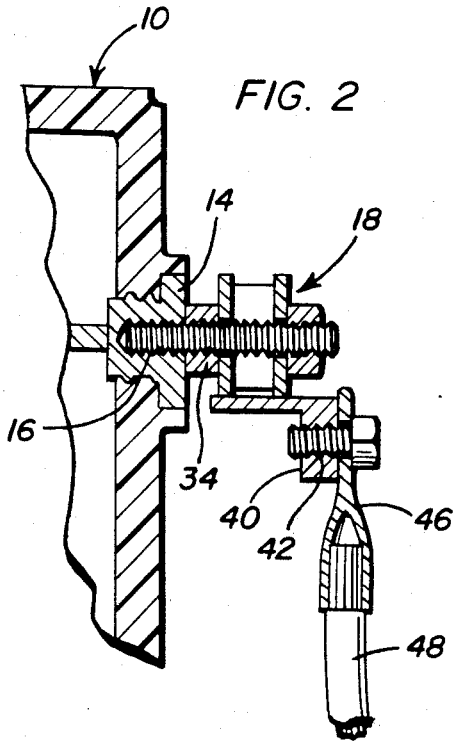
FIG. 2 is an enlarged fragmentary vertical sectional view taken substantially upon the plane indicted by the section line 2—2 of FIG. 1.
Figure 4:
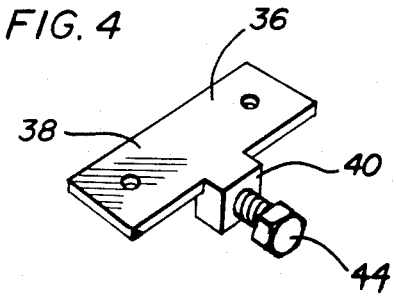
FIG. 4 is a perspective view of the first form of battery cable mounted contact member shown in FIGS. 1–3 and forming a part of the instant invention.

In order to establish a readily releasable electrically connection between the cable 48 and the terminal 14, it is merely necessary to place the contact member 36 position with the planar face thereof abutting, bridging and magnetically attracted to one pair of corresponding longitudinal marginal edges of the plates 20 and 22, see FIGS. 1 and 2. In this manner, a good electrical connection is established between the battery cable and the post 14. In addition, if the battery cable is to approach the battery 10 from above as opposed to from below, it is merely necessary to abut the planar face 38 of the contact member 36 against the upper longitudinal marginal edges of the plates 20 and 22 as opposed to the lower longitudinal marginal edges thereof.

Figure 5:
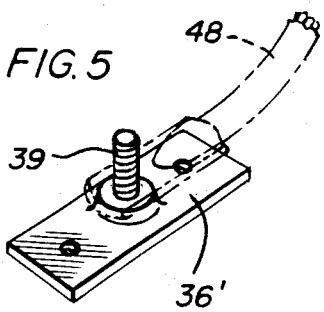
FIG. 5 is a perspective view of a second form of battery cable mounted contact member.
Figure 3:
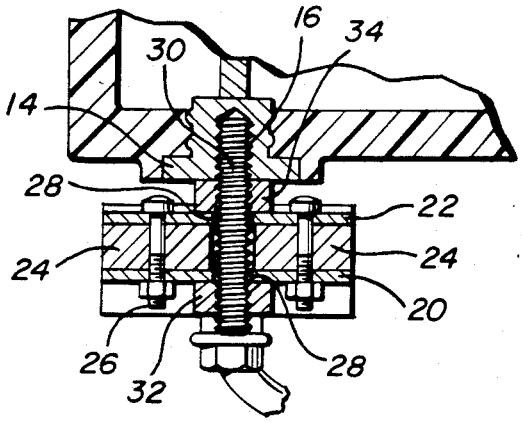
FIG. 3 is an enlarged fragmentary horizontal sectional view taken substantially upon the plane indicated by the section line 3—3 of FIG. 1.

With attention invited more specifically to FIG. 5 of the drawings, there may be seen a modified form of contact member referred to in general by the reference numeral 36'. The contact member 36' includes a threaded stud 39 projecting outwardly from one side face of the contact member 36' and it is believed apparent that the end member 46 may be electrically connected to the contact member 36' through the utilization of a suitable threaded nut (not shown) threaded downwardly upon the stud 39 after the apertured end member 46 has been telescoped downwardly over the stud 39.

Inasmuch as the stud projects outwardly from one side face of the contact member 36' as oppposed to projecting outwardly from one longitudinal marginal edge of the contact member 36', yet another variation in the manner in which the battery 48 may be electrically connected to the post 14 is provided.

Figure 6:
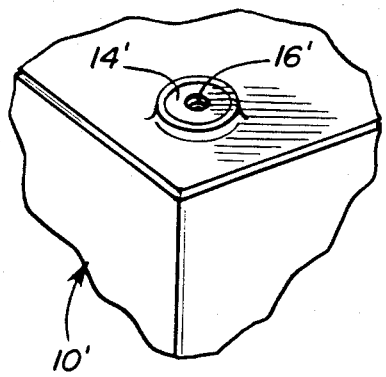
FIG. 6 is a fragmentary perspective view of a second form of battery including top mounted flush battery posts of the type including an outwardly opening threaded bore.

With attention now invited more specifically to FIG. 6 of the drawings, there may be seen a modified form of battery referred to in general by the reference numeral 10'. The battery 10' includes a pair of battery terminals 14' (only one of which is shown) and the terminals 14' comprise top mounted terminals and include upwardly opening threaded bores 16'. Of course, the connector 18 may be electrically connected to the terminal 14' in the same manner in which it is electrically connected to the terminal 14.

If it is desired to rapidly disconnect the cable 48 from the terminal 14, it is merely necessary to grip the cable and/or the contact member 36 and to slide the contact member 36 from engagement with the plates 20 and 22. Of course, an electrical connection between the contact member 36 and the plates 20 and 22 may be just as easily reestablished.

It is also pointed out that in the event corrosion builds up about the electrically contacted portions of the plates 20 and 22 and the planar face 38, such a buildup of corrosion may be readily removed merely by sliding the planar face 38 back and forth across the corresponding edges of the plates 20 and 22. This may be accomplished within a matter of seconds.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A battery cable-to-battery post connector for use in conjunction with a battery of the type including a recessed battery post having an outwardly opening threaded bore formed therein, said connector including a pair of generally parallel electrically conductive and ferrous plates, permanent magnet means sandwiched and secured between said plates, an elongated electrically conductive threaded fastener including at least a portion thereof projecting outwardly of the side of one of said plates remote from the other plate electrically connected to both of said plates and adapted for threaded anchoring in said bore, said connector also including an electrically conductive contact member constructed of ferrous material and to which one end of a battery cable may be electrically connected, said contact member including at least one generally planar side, said plates including exposed corresponding side marginal edges disposed in the same plane, said contact member being positionable with said planar side abutted against, spanning the spacing between and magnetically attracted to said edges.

2. The connector of claim 1 wherein the planar side of said contact member is of dimensions whereby remote marginal edges of said planar side are spaced apart a greater distance than the spacing between the remote sides of said plates.

3. The connector of claim 1 wherein said elongated threaded fastener is secured through said plates.

4. The connector of claim 1 wherein said plates include two pairs of exposed corresponding side marginal edges which project outwardly of the corresponding side of said magnet means, each pair of said side marginal edges being disposed in a corresponding plane, said planar side being abuttingly and magnetically engageable with either pair of said side marginal edges.

5. The connector of claim 1 wherein said magnet means includes a pair of magnets sandwiched between said plates and disposed in spaced apart relation, said threaded fastener being secured through said plates and passing through the spacing between said magnets.

6. The connector of claim 1 wherein the outwardly projecting portion of said fastener includes spacer means thereon outwardly beyond which said fastener projects with said spacer means being adapted to space said one plate from said terminal.

7. The connector of claim 1 wherein said contact member comprises a contact plate with opposing sides and wherein one of said opposing sides comprises said planar side, the other side of said plate including an outwardly projecting threaded stud to which an apertured battery cable end member may be anchored.

8. The connector of claim 1 wherein said contact member comprises a contact plate having opposite sides and with one of said opposite sides comprising said planar side, a lug carried by one marginal edge portion of said plate and projecting outwardly of the other side of said contact plate and having a threaded bore formed therethrough in which a threaded shank for anchoring the end member of a battery cable may be secured.

9. In combination with a battery of the type including a recesses battery post provided with an outwardly opening threaded bore, a connector for electrically connecting a battery cable to said post, said connector including a pair of generally parallel electrically conductive and ferrous material plates, permanent magnet means sandwiched between said plates, an elongated electrically conductive threaded fastener including at least a portion thereof projecting outwardly of the side of one of said plates remote from the other plate, electrically connected to both of said plates and threadedly anchored in said bore, said connector also including an electrically conductive contact member to which one end of a battery cable is electrically connected and including at least one generally planar side, said plates including exposed corresponding side marginal edges disposed in the same plane, said contact member being abutted against, spanning and magnetically anchored to said edges.

10. The combination of claim 9 wherein said planar side is of dimensions such that remote marginal edges of said planar side project outwardly of the remote sides of said plates.

11. The combination of claim 9 wherein said elongated threaded fastener is secured through said plates.

12. The combination of claim 9 wherein said magnet means includes a pair of magnets sandwiched between said plates and disposed in spaced apart relation, said threaded fastener being secured through said plates and passing through the spacing between said magnets.

* * * * *